US005511245A

United States Patent [19]

Hayes

[11] Patent Number: 5,511,245

[45] Date of Patent: Apr. 30, 1996

[54] COLD WEATHER CLOTHING INCLUDING COEXTENSIVE FIBROUS INSULATION LAYER WITHIN SHELL AND FOAM INSERTS IN STRESS AREAS

[75] Inventor: Christopher J. Hayes, Rockford, Mich.

[73] Assignee: Specialty Sports Limited, Rockford, Mich.

[21] Appl. No.: 240,829

[22] Filed: May 11, 1994

[51] Int. Cl.[6] ..... A41D 1/06

[52] U.S. Cl. ..... 2/79; 2/272

[58] Field of Search ..... 2/79, 85, 93, 97, 2/227, 228, 243.1, 267, 272, 2, 80, 81

[56] References Cited

U.S. PATENT DOCUMENTS 4,100,620 7/1978 Pecoraro ..... 2/2
4,397,043 9/1983 Croteau ..... 2/2
4,783,858 11/1988 Chevalier ..... 2/272
4,993,077 2/1991 Robinson .
5,052,052 10/1991 Gilford et al. ..... 2/2
5,134,726 8/1992 Ross ..... 2/2
5,388,271 2/1995 Sessoms ..... 2/2

*Primary Examiner*—C. D. Crowder
*Assistant Examiner*—Gloria Hale
*Attorney, Agent, or Firm*—Price, Heneveld, Cooper, DeWitt & Litton

[57] ABSTRACT

Cold weather clothing includes a fabric shell defining a cavity. A flexible polymeric foam sheet material is inserted into the shell to provide insulation for the wearer.

10 Claims, 2 Drawing Sheets

COLD WEATHER CLOTHING INCLUDING COEXTENSIVE FIBROUS INSULATION LAYER WITHIN SHELL AND FOAM INSERTS IN STRESS AREAS

BACKGROUND OF THE INVENTION

The present invention pertains to garments, and more particularly to insulated garments of the type which provide thermal protection in cold weather.

Insulated jackets and pants have long been known for protecting people in cold weather. These garments are typically manufactured of a fabric having wind breaking capability. To provide warmth, these garments are filled with insulation. Typical insulations include down, a natural insulator, or man-made fibrous materials, such as Thinsulate®.

Although known outerwear provides excellent insulative qualities when new, they are typically subjected to rigorous use. For example, such clothing is often used for hunting, snowmobiling, skiing, and a variety of other winter activities. A difficulty encountered with known outerwear is that the insulation will compress or stretch from those locations subject to movement or other forces. For example, insulation may be compressed/stretched in the area around the knee by the natural flexing of the knee during movement. Insulation may also be compressed/stretched in the elbow area. Another location where insulation may be compressed during use, is the seat area. For example, for snowmobilers the portion of the clothing upon which the wearer sits is subject to the full weight of the user, thereby compressing the insulation and reducing the R factor of that insulation.

Accordingly, it is desirable to provide improved insulated outerwear for cold weather use by active people which will not lose its insulative qualities. It is further desirable that the outerwear be light in weight, and permit free movement by the individual, in whatever activity he/she is participating.

SUMMARY OF THE INVENTION

The present invention overcomes the disadvantages of the prior art by providing an outerwear garment having flexible polymeric foam sheet material at least in those locations where fibrous material insulation may be destroyed during use, or where extra warmth is desired. The strategic use of the polymeric foam sheets provides a significantly more durable insulation for the cold weather clothing. The insulation is durable and flexible, standing up to the rigors of outdoor activities to which cold weather clothing is typically subject, without hindering the wearer.

These and other objects, aspects and features of the immediate invention will become apparent upon reading the following more detailed description of the invention and referencing the attached drawings, in which:

DETAILED DESCRIPTION OF THE PREFERRED EMBODIMENTS

Figure 1:
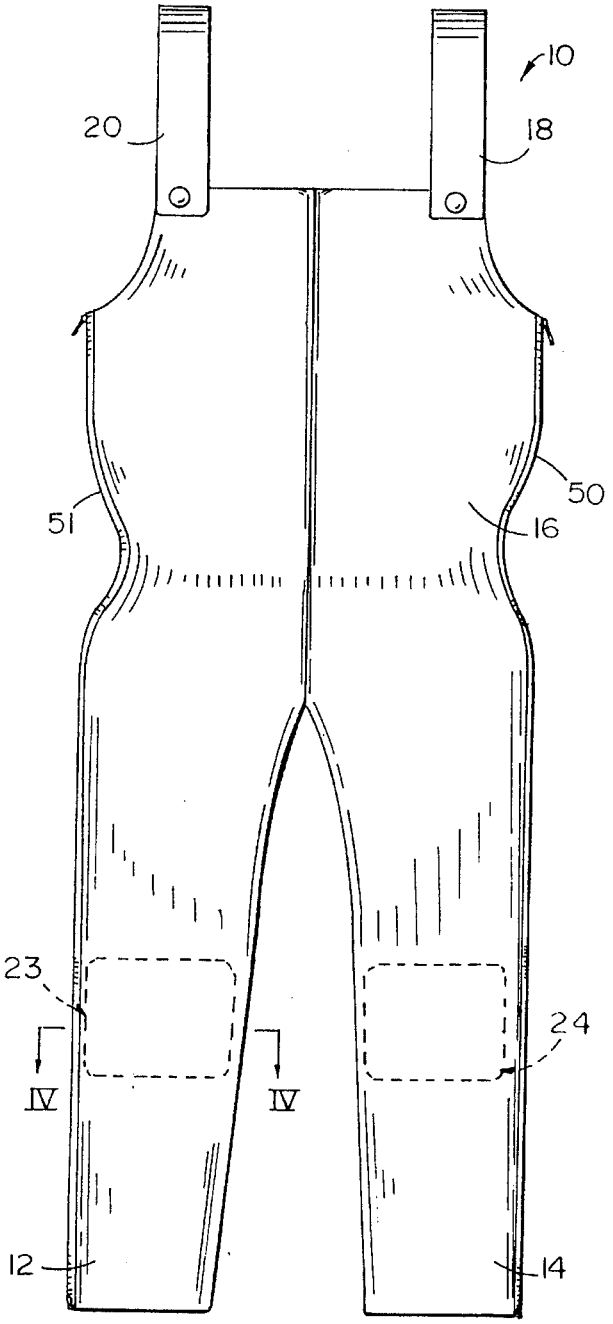
FIG. 1 is a front elevational view of a cold weather outerwear article of clothing according to the invention.
Figure 2:
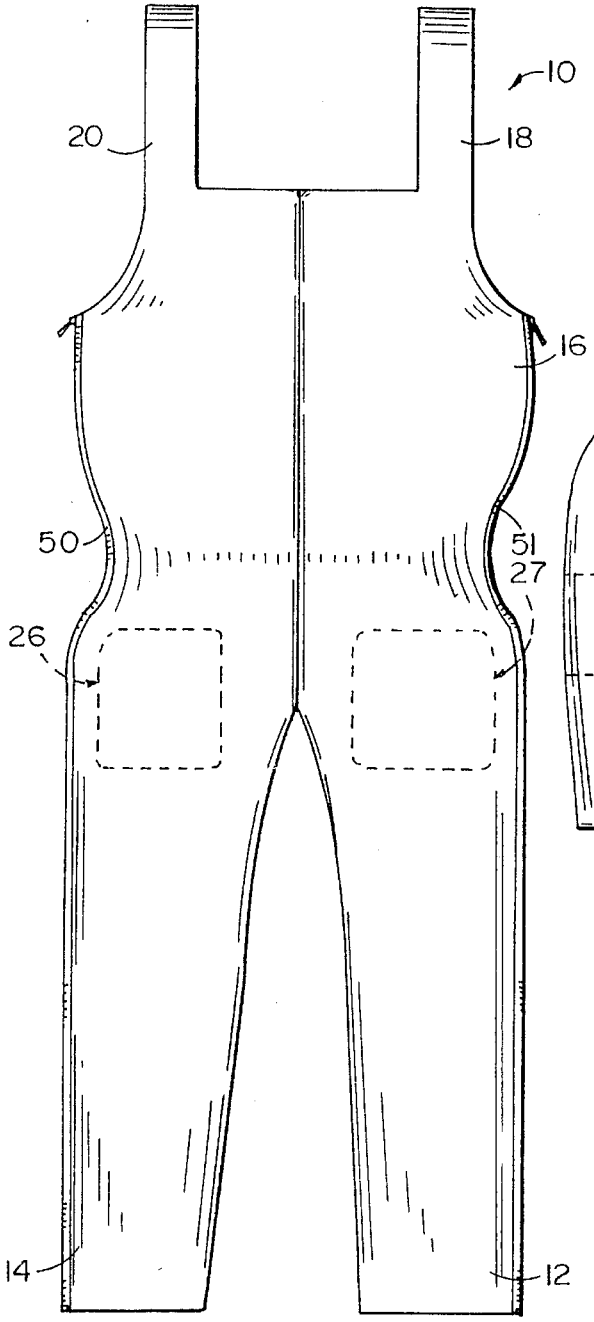
FIG. 2 is a rear elevational view of the outerwear article of FIG. 1.
Figure 3:
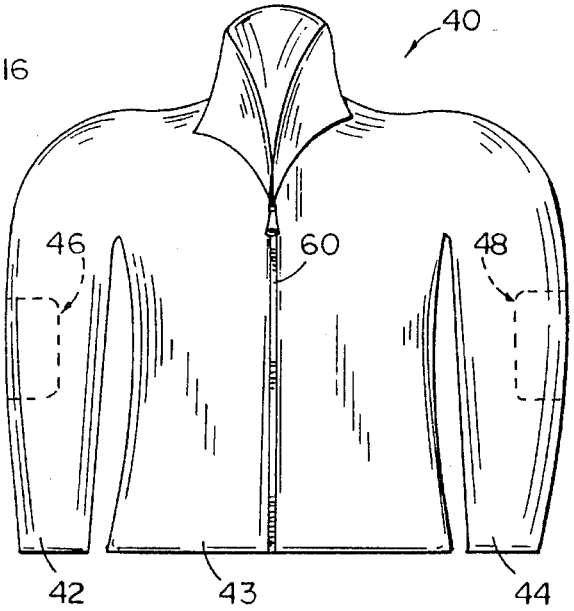
FIG. 3 is a front elevational view of another cold weather outerwear clothing article embodying the invention.

In the preferred embodiment, outerwear garment 10 includes legs 12 and 14, a midsection 16 and shoulder straps 18 and 20 (FIGS. 1 and 2). Flexible polymeric foam sheets 23, 24 and 26, 27 are positioned at those locations where a wearer's activity may cause displacement, or destruction, of the fibrous material which serves as the insulation for the outerwear, or where added warmth is desired, or both. Although the outerwear illustrated in FIGS. 1 and 2 is a pair of snowpants, those skilled in the art will recognize that the invention may be embodied in a jacket (FIG. 3), a snowsuit, or any other cold weather, insulated clothing article.

Insulated outerwear 10 includes an inner layer of fabric 36 (FIG. 4) for positioning against the wearer. An outer layer of fabric 30 faces outwardly. The inner and outer fabrics define a cavity therebetween. The cavity includes sufficient space to receive fibrous insulation 34, which is preferably a commercially available fibrous insulation material. The fibrous material 34 is preferably coextensive with the inner layer 36 and outer layers 30, such that the article of clothing will insulate the wearer over the entire body area covered by the garment. The garment may be of any suitable construction, and thus may include inner and outer layers which are sewn together along seams (not shown) to form the cavity in which the insulation is positioned.

Figure 4:
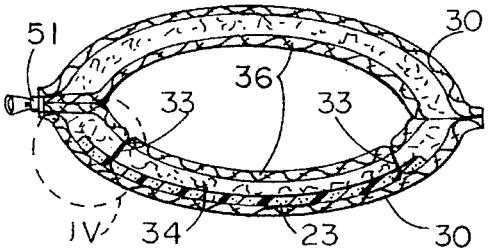
FIG. 4 is a cross-sectional view of the outerwear garment taken along plane IV—IV in FIG. 1.
Figure 5:
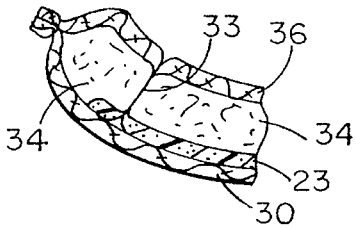
FIG. 5 is an enlarged, fragmentary view of encircled portion V of FIG. 4.
Figure 7:
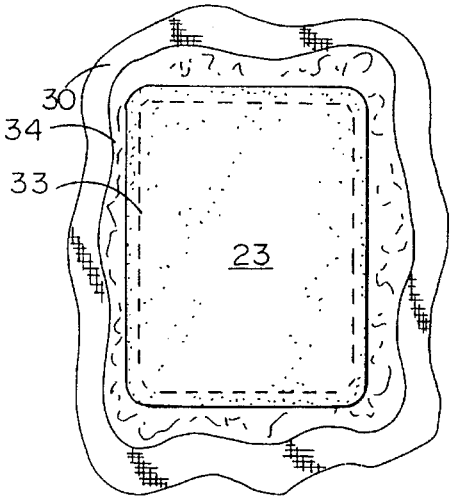
FIG. 7 is a fragmentary plan view of fibrous insulation with a polymeric foam sheet sewn thereto.

A flexible polymeric foam sheet is positioned within the cavity at desired locations, most preferably where motion by the user, or other stresses, would otherwise result in separation of the fibrous material 34. The foam sheet is substantially smaller in surface area than the outer layer of fabric. Thus, the foam sheets 23, 24 (FIG. 1) are sewn into the knee area of legs 12, 14. Polymeric foam sheets 26, 27 (FIG. 2) are sewn into the seat of snowpants 20. The polymeric foam sheets are flexible and are positioned adjacent the fibrous material. The foam sheets are sewn to the fabric inner layer by thread 33 (FIGS. 4, 5 and 7) such that the fibrous insulation 34 is positioned between the fabric 36 and the foam sheet, as illustrated in FIGS. 4 and 5. The flexible polymeric foam sheets and the fibrous material are thus provided adjacent one another to insulate the high stress sections of the outerwear and provide excellent insulative qualities.

The flexible polymeric foam sheets 23, 24, 26, 27, 46 and 48 may be made of any suitable flexible polymeric foam material. Preferably, the material is a closed cell polymeric foam, and most preferably, the article is constructed of a flexible polystyrene foam. Other examples of foams which may be advantageously employed include flexible polyethylene, flexible polypropylene, or flexible polyfluorocarbonate.

Figure 6:
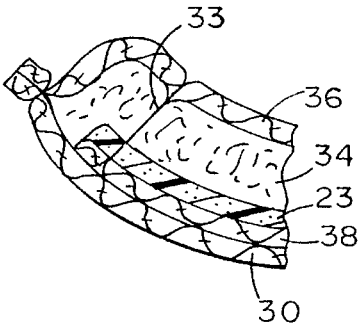
FIG. 6 is an enlarged, fragmentary cross-sectional view, similar to FIG. 5, but of an alternate embodiment of the outerwear garment.

According to another embodiment of the invention, a piece of fabric 38 is positioned over a sheet of polymeric foam 32 (FIG. 6). This creates a pocket for the polymeric foam, with the polymeric foam sheet 32 and the fibrous insulation 34 sewn between two layers of fabrics 36, 38. This sandwiches the fibrous material 34 and foam sheet 32 between fabric providing additional strength against tearing of the foam 23 and separation of the fibrous insulation 34 at the stress locations. The outer layer 30 does not show the threads 33 in either embodiment.

Although the polymeric foam is illustrated to be generally rectangular in configuration, those skilled in the art will recognize that the polymeric sheets can have any suitable shape, such as oval, rectangular, square or generally square or rectangular with rounded corners.

To assemble the article of clothing, inner fabric layer 36 and outer fabric layers 30 are cut to a desired shape. The fibrous insulation is also cut to the same shape. The flexible polymeric foam sheets 23, 24, 26, 27 are then sewn to the fibrous insulation 34 and inner fabric layer 36 at those locations where the insulated material will be subject to stress. If a layer of fabric backing 38 is used, the fabric backing is sewn on at the same time as the foam sheets. The outer fabric layer is then sewn to the inner fabric layer. It is envisioned that the polymeric sheet could be attached to or located in the garment by other means, such as using an adhesive, a hook and clasp-type connector, such as the Velcro®, a two-sided adhesive, or the like.

Accordingly, it can be seen that an insulated garment is disclosed which is durable and does not restrict the wearer's movement. The garment will hold up in rigorous use without losing its insulative capability.

Although the invention has been described with respect to specific preferred embodiments thereof, many variations and modifications will become apparent to those skilled in the art. It is, therefore, the intention that the appended claims be interpreted as broadly as possible in view of the prior art to include all such variations and modification.

The embodiments of the invention in which an exclusive property or privilege is claimed are defined as follows:

1. An insulated clothing article for cold weather use, comprising:

an inner layer of fabric;

an outer layer of fabric interconnected to said inner layer of fabric to define a shell;

said shell having a cavity therein, such shell dimensioned so as to cover at least a portion of a wearer's body;

fibrous insulation positioned in said cavity substantially coextensive with said shell to keep the wearer warm in those locations where the shell covers the wearer;

at least one flexible polymeric foam sheet positioned in said cavity; and wherein said at least one foam sheet is substantially smaller in surface area than said outer layer of fabric, and said at least one foam sheet is positioned adjacent said fibrous insulation at at least one location where the clothing article experiences a significant amount of stress to preserve the insulative quality of the clothing at said at least one location without restricting movement of the wearer.

2. The insulated clothing article as defined in claim 1, wherein a fabric backing is positioned over said foam sheet.

3. The insulated clothing article as defined in claim 2, wherein said polymeric foam sheet is a closed cell polymeric foam.

4. The insulated clothing article as defined in claim 2, wherein said fabric backing is sewn to said inner fabric layer with said at least one foam sheet and said fibrous material sewn therebetween.

5. The insulated clothing article as defined in claim 1, wherein said at least one polymeric foam sheet is sewn to said inner layer of fabric with said fibrous insulation positioned therebetween.

6. The insulated clothing article as defined in claim 1, wherein said insulated outerwear includes two legs and a midsection for covering the body and legs of the wearer.

7. The insulated clothing article as defined in claim 1, said article including one or more knee areas and a seat area and further including a pocket in each knee area and on each side of the seat area, there being a polymeric foam sheet located in each said pocket.

8. The insulated clothing article as defined in claim 1, said article including a seat area, and said at least one polymeric foam sheet being positioned in said seat area.

9. The insulated clothing article as defined in claim 1, said article including a seat area having a first side and a second side, there being a polymeric foam sheet positioned in each of said first and second sides.

10. The insulated clothing article as defined in claim 1, said article including at least one knee area, there being a polymeric foam sheet positioned in said knee area.

* * * * *